United States Patent [19]

Gross

[11] 3,993,969

[45] Nov. 23, 1976

[54] VACUUM-TIGHT WINDOW ARRANGEMENT FOR RECTANGULAR WAVEGUIDES

[75] Inventor: Franz Gross, Munich, Germany

[73] Assignee: Siemens Aktiengesellschaft, Berlin, Munich, Germany

[22] Filed: Sept. 22, 1975

[21] Appl. No.: 615,403

[30] Foreign Application Priority Data

Nov. 15, 1974 Germany ..... 382346

[52] U.S. Cl. ..... 333/98 P; 333/33; 333/98 R

[51] Int. Cl.[2] ..... H01P 1/08; H01P 5/08

[58] Field of Search ..... 333/98 R, 98 P, 33, 333/98 M

[56] References Cited

UNITED STATES PATENTS

| | | | |
|---|---|---|---|
| 3,281,729 | 10/1966 | Kato et al. | 333/98 P |
| 3,289,122 | 11/1966 | Vural | 333/98 |
| 3,315,188 | 4/1967 | Scott | 333/98 P |
| 3,436,694 | 4/1969 | Walker | 333/98 |
| 3,753,171 | 8/1973 | Butwell | 333/98 P |
| 3,860,891 | 1/1975 | Hiramatsu | 333/98 P X |

*Primary Examiner*—Eli Lieberman
*Assistant Examiner*—Marvin Nussbaum
*Attorney, Agent, or Firm*—Hill, Gross, Simpson, Van Santen, Steadman, Chiara & Simpson

[57] ABSTRACT

A vacuum-tight window arrangement includes a hollow cylindrical housing having an aperture in each end which constricts the width of a waveguide between the apertures. The waveguide carries a transversely mounted dielectric window. A combination of proportioning rules based on waveguide width, aperture width, aperture thickness, window-to-aperture distance and wavelength of the center frequency provide a window arrangement which is stable with respect to interfering modes over a large frequency range at high operating efficiency and very short wavelengths.

10 Claims, 2 Drawing Figures

VACUUM-TIGHT WINDOW ARRANGEMENT FOR RECTANGULAR WAVEGUIDES

BACKGROUND OF THE INVENTION

1. Field of the Invention

This invention relates to a vacuum-tight window arrangement for high power tubes for the purpose of operating in the mm range, with a rectangular waveguide, containing a one-piece dielectric rectangular window which allows waves to pass therethrough, the window having a thickness corresponding approximately to half the wavelength of the wave of the center operating frequency, and a pair of apertures which symmetrically constrict the broad dimension of the waveguide and which are arranged in front of and behind, respectively, the rectangular window in the course of the waveguide.

2. Description of the Prior Art

Presently known microwave windows having an inductivity compensated rectangular dielectric have repeatedly proven themselves; however, in some cases, for example, in the case of certain wideband high power tubes, such windows are not capable of meeting the demands required of them. Therefore, particularly in the case of high operating energies and high operating frequencies, there is the danger of arcing in the area of the aperture. In addition, under such extreme operating conditions, it is possible that disturbing resonances (so-called "trapped modes" or "ghost modes") may be formed, which, by changing the adjustment values, lead to amplification fluctuations in the operating range of the tubes, on the one hand, and, due to consumption of power, heat or destroy the window, on the other hand and thereby altogether permit actual use of only one segment of the theoretically possible bandwidth.

For these reasons, even in the case of high power linearbeam tubes, there has been a prevalent changeover to round window embodiments, in which the transition point between the rectangular cross section of the conductor and the window cross section takes place either steadily (round windows with transition points) or abruptly at a fixed interval from the dielectric (box windows). In this regard, reference is made to "High Power Linear Beam Tubes," A. Staprans et al, in the "Proceedings Of The IEEE", Vol. 61, No. 3, 1973, pp. 299 to 330, particularly Section II D. Window constructions of this type are, indeed, more high-voltage proof, and are more capable of being loaded due to the symmetrical distribution of mechanical and thermal tensions; however, such constructions still exhibit a considerable susceptibility to interference modes. Moreover, the tendency toward oscillation build-up delicately depends upon what degree the symmetry of the arrangement is disturbed, and therefore, for example, to what extent the two rectangular-conductor elements are rotated toward one another. Therefore, radially symmetrical windows require very careful asssembly and, nevertheless, are not completely controllable in their transmission properties and working life properties. These breaks in quality, due to interfering modes, gave rise to a series of counter measures, which are expensive in part; for example, a specific shaping of the dielectric (U.S. Pat. No. 3,594,667).

SUMMARY OF THE INVENTION

Accordingly, a window is lacking which, above all, is stable with regard to interfering modes over a large frequency range at high operating efficiencies and very short operating wavelengths, and which uniformly reflects little, and at the same time exhibits a sufficient dielectric strength, consumes little power, and presents no particular fabrication problems; and it is the primary object of the invention to provide such a window.

According to the invention, and in order to close this gap, a window arrangement of the type initially mentioned is proposed which is characterized by the combination of proportioning rules $$04<1a<0.6,$$
$$0.1<d_B/\lambda_o<0.15, \text{ and}$$
$$0.65<a'/a<0.85$$

wherein 1 is the clear interval between the rectangular window and the apertures which are provided with round edges according to a known procedure, $a$ is the clear width of the waveguide, $d_B$ is the thickness of an aperture, $\lambda_o$ is the wavelength in free space corresponding to the center operating frequency, and $a'$ is the clear width of the waveguide at the location of the apertures. It is advisable to select the interval 1 to be even smaller than $\lambda_o/2$.

A window constructed in accordance with the invention first presents itself as resorting to the conventional rectangular form with adjustment apertures which, for example, also serves as a point of departure for that disclosed in the German allowed application 1,766,147; the latter being, however, modified in a comparatively expensive manner. In contrast, excellent adjustment values are obtained according to the instant invention alone within the framework of the specific instructions for dimensioning which are proposed herein. Therefore, over a bandwidth of 20%, and centered at approximately 37 GHz, a window constructed according to the invention exhibited a reflection factor $r$ of $r$ <5%; i.e., a power standing wave ratio $m$ of $m<1.1$, whereby no interfering modes could be registered in this band. This result is all the more remarkable in that it is achieved with abnormally thick and wide apertures, which, due to the known stronger frequency dependency of their inductive transverse conductance, rather caused one to expect a loss in bandwidth compared with apertures having thin walls, and therefore were also not taken into consideration before. On the other hand, however, thick apertures with softly rounded edges have lower losses in wall current and a high dielectric strength which, as could be determined, can fully compete with that of a box window. The arrangement itself, due to its solid apertures located close to the dielectric, provides a good heat transport capability, a high mechanical stability, and can be comparatively easily fabricated and assembled.

BRIEF DESCRIPTION OF THE DRAWING

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
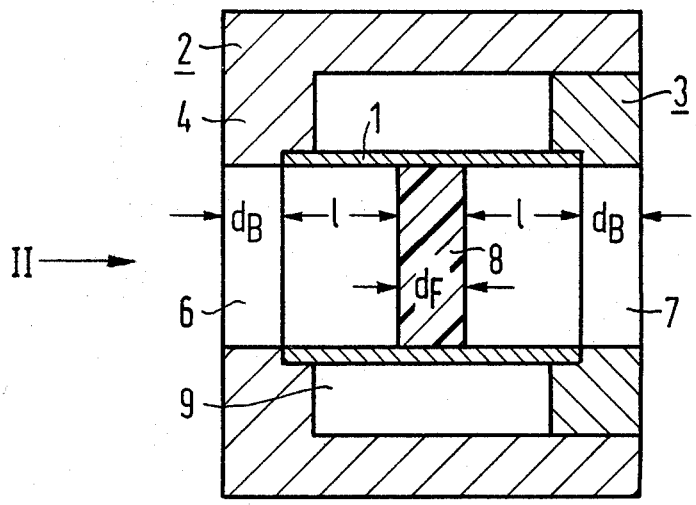
FIG. 1 is a longitudinal sectional view of an exemplary embodiment of a window arrangement constructed in accordance with the invention.
Figure 2:
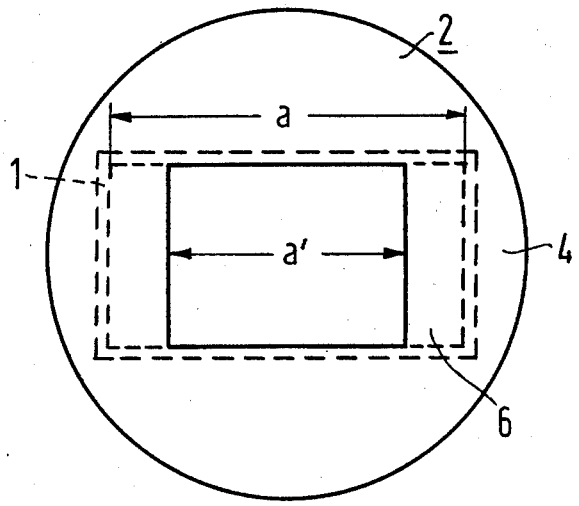
FIG. 2 illustrates the exemplary embodiment of FIG. 1 as seen in the direction II of FIG. 1.

The window illustrated in FIGS. 1 and 2 of the drawing is intended for a high power traveling wave amplifier. It comprises a center element 1 which is rectangular in cross section, as well as two cylindrical side elements 2 and 3. The side element 2 is constructed in a cup-shaped form having a base section from which the wave guide section, loaded with an aperture 6, is constructed. The side element 3 is formed as a disc-shaped member and has, in its central region, like the base section 4 of the element 2, an aperture 7.

The base section 4 and the element 3 have recesses about the respective apertures 6 and 7 for receiving the central element 1. The central element 1 encloses a window 8 of dielectric material, for example $A1_2O_3$ or BeO, sealed in a vacuum-tight manner. The window thickness $d_F$ is $\lambda_o/2 \cdot \sqrt{\epsilon}$, where $\epsilon$ is the dielectric constant of the dielectric material of the window. The central element 1 itself may consist of a thin-walled copper section, in order that the vacuum seal remains tight for a long period, even under prevailing operating temperatures. All three of the elements 1, 2 and 3 are fitted into one another and secured to one another. There therefore remains a channel 9, which extends about the central element 1 and through which a cooling medium can flow.

On the drawings, 1 designates the distance between the window and each of the apertures, $a$ is the width of the waveguide (the inner width of the central element 1), $d_B$ is the width of each of the apertures, $a'$ is the width of the waveguide at the position of an aperture, and the median wavelength of the operating band is represented by $\lambda_o$ always lies between $a$ and $2a$, preferably at $1.2a$ to $1.5a$.

A window dimensioned according to the invention is shorter and more sturdy than the round window with transition points, which is particularly endangered by interfering modes; its length corresponds approximately to that of the box window. It is distinguished above all, by a greater bandwidth with a lesser susceptibility to interfering modes.

A particularly favorable set of values, for example in the case of a BeO window, can be obtained with the more specific ranges of measurements of:

$$0.46 < 1/a < 0.53,$$
$$0.12 < d_B/\lambda_o < 0.14, \text{ and}$$
$$0.75 < a'/a < 0.8.$$

Although I have described my invention by reference to particular embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A vacuum-tight window arrangement for high power transit time tubes operating in the mm range, comprising:
   - a rectangular waveguide center element containing a one-piece rectangular dielectric window which is permeable to waves and having a thickness which corresponds to approximately $\lambda_o/2 \cdot \sqrt{\epsilon}$ of the center-frequency passing through the window,
   - a pair of rectangular apertures on opposite sides of said window,
   - the elements related by the combined expressions $$0.4 < 1/a < 0.6,$$

$$0.1 < \frac{d_B}{\lambda_o} < 0.15, \text{ and}$$

$$0.65 < a'/a < 0.85,$$

where 1 is the distance between said window and each aperture, $a$ is the internal width of said waveguide, $d_B$ is the thickness of the an aperture, $\lambda_o$ is the wavelength of the center frequency, $\epsilon$ is the dielectric constant of the material of the window, and $a'$ is the internal waveguide width at the apertures.

2. The window arrangement of claim 1, wherein the relationship $1 < \lambda_o/2$ holds true.

3. The window arrangement of claim 1, comprising:
   - a rectangular waveguide center element containing said window,
   - a cylindrical housing mounting said center element and
   - including said pair of rectangular apertures in the ends of said housing and comprising
   - a cup-shaped member including an end wall having one of said apertures therein, and
   - a disc-shaped member having the other aperture therein disposed in the open end of said cup-shaped member.

4. The window arrangement of claim 3, wherein each of said housing members includes a recess adjacent the respective aperture receiving a respective end of said center element.

5. The window arrangement of claim 1, wherein the combined expressions are more specifically $$0.46 < 1/a < 0.53,$$

$$0.12 < \frac{d_B}{\lambda_o} < 0.14, \text{ and}$$

$$0.75 < a'/a < 0.8.$$

6. The vacuum-tight window arrangement of claim 5, wherein said rectangular waveguide is spaced from the inner surface of said side wall forming a coolant chamber therebetween.

7. The vacuum-tight window arrangement of claim 5, wherein the cross-sectional dimensions of said waveguide and said apertures transverse to $a$ and $a'$ are equal.

8. The vacuum-tight window arrangement of claim 5, wherein said waveguide comprises copper.

9. A vacuum-tight window arrangement for high power transit time tubes, comprising:
   - a cup-shaped member including a cylindrical side wall and an end wall;
   - a disc-shaped member sealed to said cylindrical side wall opposite said end wall;
   - a pair of rectangular apertures aligned with each other and located in said end wall and said disc-shaped member respectively;
   - a pair of rectangular recesses aligned with each other and located about respective ones of said apertures;
   - a rectangular waveguide having a pair of ends, each of said ends disposed in a respective recess and sealed to said end wall and said disc-shaped member, respectively;

a dielectric window mounted sealed within and across said rectangular waveguide;

said window having a thickness of approximately $\lambda_o/2 \cdot \sqrt{\epsilon}$ of the center frequency dimensioned according to the relationships

$$0.4<1/a<0.6,$$

$$0.1 < \frac{d_B}{\lambda_o} < 0.15, \text{ and}$$

$$0.65<a'/a<0.85,$$

where 1 is the distance between said window and each aperture, $a$ is the internal width of the waveguide, $d_B$ is the thickness of an aperture, $\lambda_o$ is the wavelength of the center frequency, $\epsilon$ is the dielectric constant of the material of the window, and $a'$ is the internal width of the waveguide at an aperture.

10. The vacuum-tight window arrangement of claim 9, wherein said window is a BeO window and the dimensioning relationships are more specifically defined as $$0.46<1/a<0.53,$$

$$0.12 < \frac{d_B}{\lambda_o} < 0.14, \text{ and}$$

$$0.75<a'/a<0.8.$$

* * * * *